US011766105B2

(12) United States Patent
Krulik et al.

(10) Patent No.: US 11,766,105 B2
(45) Date of Patent: Sep. 26, 2023

(54) COMPRESSION-EXPANSION LOCKING DEVICE FOR LUGGAGE AND LUGGAGE CONTAINING SAME

(71) Applicant: Briggs and Riley Travelware, LLC, Hauppauge, NY (US)

(72) Inventors: Richard Krulik, Northport, NY (US); Georgene Rada, Northport, NY (US); Florian M. Witt, Wentorf (DE); Patric Moammer, New York, NY (US); Adrian Berr, Brooklyn, NY (US)

(73) Assignee: BRIGGS & RILEY TRAVELWARE LLC, Hauppauge, NY (US)

( * ) Notice: Subject to any disclaimer, the term of this patent is extended or adjusted under 35 U.S.C. 154(b) by 0 days.

(21) Appl. No.: 17/537,880

(22) Filed: Nov. 30, 2021

(65) Prior Publication Data

US 2022/0167718 A1 Jun. 2, 2022

Related U.S. Application Data

(60) Provisional application No. 63/119,712, filed on Dec. 1, 2020.

(51) Int. Cl.
*A45C 7/00* (2006.01)
*A45C 13/10* (2006.01)

(52) U.S. Cl.
CPC ..... *A45C 7/0031* (2013.01); *A45C 13/10* (2013.01)

(58) Field of Classification Search
CPC ..... A45C 7/0031; A45C 13/10; A45C 7/0022
(Continued)

(56) References Cited

U.S. PATENT DOCUMENTS 16,336 A * 1/1857 Loewenberg ..... A45C 5/03 190/22
281,268 A 7/1883 Haskell
(Continued)

FOREIGN PATENT DOCUMENTS

CA 785061 A 5/1968
CA 2854010 C 4/2017
(Continued)

OTHER PUBLICATIONS

U.S. Appl. No. 61/628,725, entitled: Ratchet-type expansion system for luggage and luggage incorporating same, filed Nov. 4, 2011, 35 pages.

(Continued)

*Primary Examiner* — Jennifer Robertson
*Assistant Examiner* — Justin Caudill
(74) *Attorney, Agent, or Firm* — SCULLY SCOTT MURPHY AND PRESSER

(57) ABSTRACT

A compression-expansion locking device for an article of luggage and an expandable article of luggage comprising one or more such devices is disclosed. In one embodiment, the device comprises a housing member having an internal passageway with protruding housing teeth and one or more cam elements. A rack member slidably disposed in the internal passageway has rack teeth releasably engageable with the housing teeth. A release member moveably disposed in the internal passageway comprises a release cam and is displaceable from a first position locking movement of the rack member in the expansion direction, to a second position wherein the release cam impinges against the housing cam element effective to urge apart the housing teeth and rack teeth sufficient to allow movement between the housing member and the rack member in the expansion direction.

20 Claims, 12 Drawing Sheets

(58) Field of Classification Search
USPC ..... 190/115, 107, 105, 103
See application file for complete search history.

(56) References Cited

U.S. PATENT DOCUMENTS

| | | | | | |
|---|---|---|---|---|---|
| 287,473 | A | * | 10/1883 | Reetz | A45C 7/0031 190/105 |
| 440,278 | A | | 11/1890 | Payntar | |
| 526,829 | A | * | 10/1894 | Duguid | A45C 7/0031 190/105 |
| 567,026 | A | * | 9/1896 | Goldberg | A45C 7/0031 190/105 |
| 615,552 | A | | 12/1898 | Hicks | |
| 664,043 | A | | 12/1900 | Holman et al. | |
| 712,762 | A | | 11/1902 | Bukoutz | |
| 764,144 | A | | 7/1904 | McGowan | |
| 1,241,210 | A | * | 9/1917 | Harvey | A45C 7/0031 190/104 |
| 1,650,793 | A | * | 11/1927 | Walter | A45C 7/0031 292/285 |
| 1,705,525 | A | | 3/1929 | Hofschneider | |
| 1,705,526 | A | | 3/1929 | Kennedy | |
| 1,708,829 | A | * | 4/1929 | Cheney | A45C 7/0031 16/249 |
| 2,096,452 | A | * | 4/1933 | Eber | A45C 7/0031 190/115 |
| 4,163,484 | A | | 8/1979 | Delaney | |
| 6,305,513 | B1 | | 10/2001 | Lu | |
| 6,390,259 | B1 | | 5/2002 | Lu | |
| 6,408,997 | B1 | | 6/2002 | Chen | |
| 6,575,272 | B1 | | 6/2003 | Krulik et al. | |
| 6,591,950 | B1 | | 7/2003 | Scicluna | |
| 7,426,985 | B2 | | 9/2008 | Krulik et al. | |
| 7,479,900 | B2 | | 1/2009 | Horstemeyer | |
| 7,832,533 | B2 | | 11/2010 | Selvi | |
| 7,909,371 | B1 | | 3/2011 | Mihlbauer et al. | |
| 8,276,721 | B2 | | 10/2012 | Nordstrom | |
| 8,479,900 | B2 | | 7/2013 | Scicluna | |
| 9,560,902 | B2 | | 2/2017 | Hogan et al. | |
| 9,801,440 | B2 | | 10/2017 | Hogan et al. | |
| 2002/0185350 | A1 | | 12/2002 | Chang et al. | |
| 2005/0067244 | A1 | | 3/2005 | Smith et al. | |
| 2006/0042897 | A1 | | 3/2006 | Sanderson | |
| 2006/0070837 | A1 | | 4/2006 | King et al. | |
| 2007/0151820 | A1 | | 7/2007 | Lin et al. | |
| 2007/0209894 | A1 | | 9/2007 | Selvi | |
| 2009/0166138 | A1 | | 7/2009 | Gorga | |
| 2011/0048881 | A1 | | 3/2011 | Wang | |
| 2013/0140119 | A1 | | 6/2013 | Hogan et al. | |
| 2016/0366995 | A1 | * | 12/2016 | Yeh | A45C 5/02 |
| 2019/0335867 | A1 | | 11/2019 | Hogan et al. | |

FOREIGN PATENT DOCUMENTS

| | | | |
|---|---|---|---|
| CN | 2446835 | Y | 9/2001 |
| CN | 2473971 | Y | 1/2002 |
| CN | 2618482 | Y | 6/2004 |
| CN | 201142994 | Y | 11/2008 |
| CN | 201341535 | Y | 11/2009 |
| CN | 202514792 | U | 11/2012 |
| CN | 102578779 | B | 2/2016 |
| CN | 106174978 | A | 12/2016 |
| EP | 1649772 | A2 | 4/2006 |
| JP | 3077807 | B2 | 8/2000 |
| JP | 2007154368 | A | 6/2007 |
| JP | 2008515571 | A | 5/2008 |
| TW | 431615 | U | 4/2001 |
| TW | 101201849 | | 6/2012 |
| WO | 2006039725 | A2 | 4/2006 |
| WO | 2007079412 | A2 | 7/2007 |
| WO | 2013028974 | A2 | 2/2013 |
| WO | 2013142984 | A1 | 10/2013 |

OTHER PUBLICATIONS

International Search Report dated Feb. 25, 2022, received in a corresponding foreign application, 10 pages.

* cited by examiner

COMPRESSION-EXPANSION LOCKING DEVICE FOR LUGGAGE AND LUGGAGE CONTAINING SAME

RELATED APPLICATION

This application claims priority under 35 U.S.C. § 119 to provisional application U.S. Ser. No. 63/119,712 filed on Dec. 1, 2020, the entire contents of which are incorporated herein by reference.

FIELD

The disclosure relates to a compression-expansion locking device useful in luggage to securely and selectively increase or decrease the luggage capacity as needed, and to enable compact packing of the luggage article. The disclosure also relates to luggage comprising the compression-expansion locking device.

BACKGROUND

Expandable luggage as known in the art includes various designs to permit the compression and expansion of the luggage, including devices for locking the increased or decreased internal capacity of the luggage in place. Such devices are often composed of multiple parts and pieces that need to be manufactured and fit together, the resulting device itself, when installed in the luggage, typically requiring the person packing the luggage to use two hands to manipulate the device.

There is thus a need for a compression-expansion locking device of simpler construction that permits one-handed use.

SUMMARY

In one practice, the disclosure relates to a compression-expansion locking device for an article of luggage, the compression-expansion device comprising a housing member comprising an internal passageway, two columns of parallel housing teeth protruding into the internal passageway, and a pair of housing cam elements, each housing cam element disposed in axially adjacent relation to a respective one of the columns of parallel housing teeth; a rack member comprising a pair of rack arms slidably received in the internal passageway, each parallel rack arm comprising a column of parallel rack teeth adapted to releasably engage a respective one of the columns of parallel housing teeth and to allow movement between the housing member and the rack member in a compression direction and to lock movement between the housing member and the rack member in an expansion direction; and a release member moveably disposed in the internal passageway between the housing member and the side of the rack member opposite the rack teeth, the release member comprising a release cam that projects between the pair of parallel rack arms, the release member displaceable from a first position wherein movement of the rack member in the expansion direction is locked, to a second position wherein the release cam impinges against at least a portion of each housing cam element effective to urge the housing teeth away from the rack teeth sufficient to allow movement between the housing member and the rack member in the expansion direction.

In another practice, the disclosure is directed to an article of expandable luggage comprising a main luggage body having a bottom surface and a cavity formed to receive articles for packing; an expansion body having a perimeter defining a cavity; a foldable gusset joining the luggage main body to the expansion body; and a compression and locking device disposed internally at opposite ends of the article of luggage, the compression and locking device comprising a housing member affixed to one of the luggage main body or the expansion body, the housing member comprising an internal passageway, two columns of parallel housing teeth protruding into the internal passageway, and a pair of housing cam elements, each housing cam element disposed in axially adjacent relation to a respective one of the columns of parallel housing teeth; a rack member affixed to the other of the luggage main body or expansion body, the rack member comprising a pair of rack arms slidably received in the internal passageway, each parallel rack arm comprising a column of parallel rack teeth adapted to releasably engage a respective one of the columns of parallel housing teeth and to allow movement between the housing member and the rack member in a compression direction and to lock movement between the housing member and the rack member in an expansion direction; and a release member moveably disposed in the internal passageway between the housing member and the side of the rack member opposite the rack teeth, the release member comprising a release cam that projects between the pair of parallel rack arms, the release member displaceable from a first position wherein movement of the rack member in the expansion direction is locked, to a second position wherein the release cam impinges against at least a portion of each housing cam element effective to urge the housing teeth away from the rack teeth sufficient to allow movement between the housing member and the rack member in the expansion direction.

DETAILED DESCRIPTION

Figure 1A:
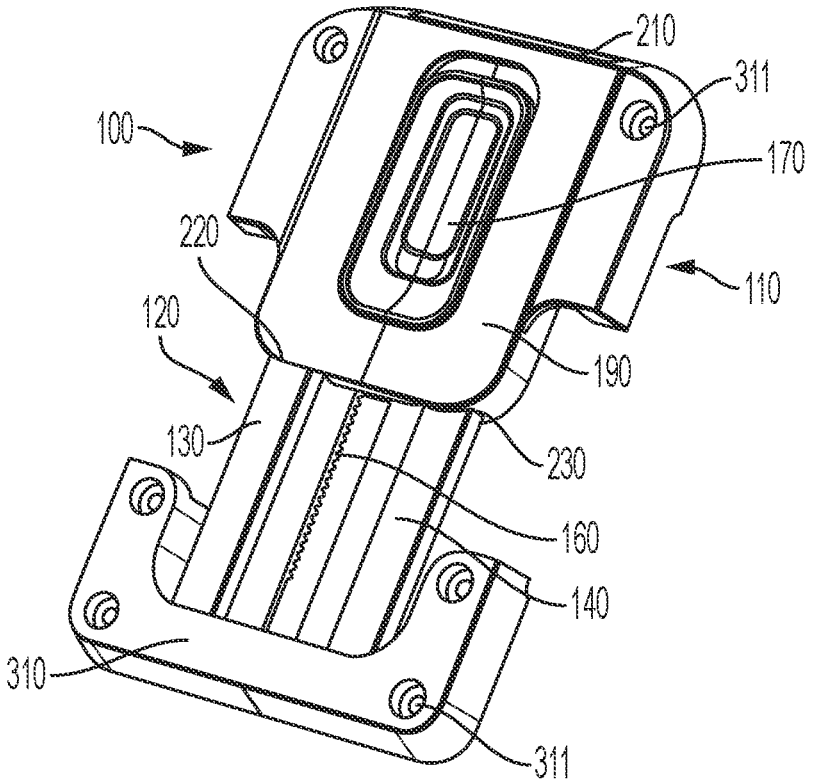
FIG. 1A is a perspective view of the front of an embodiment of a compression-expansion locking device of the disclosure in an expanded position.
Figure 1B:
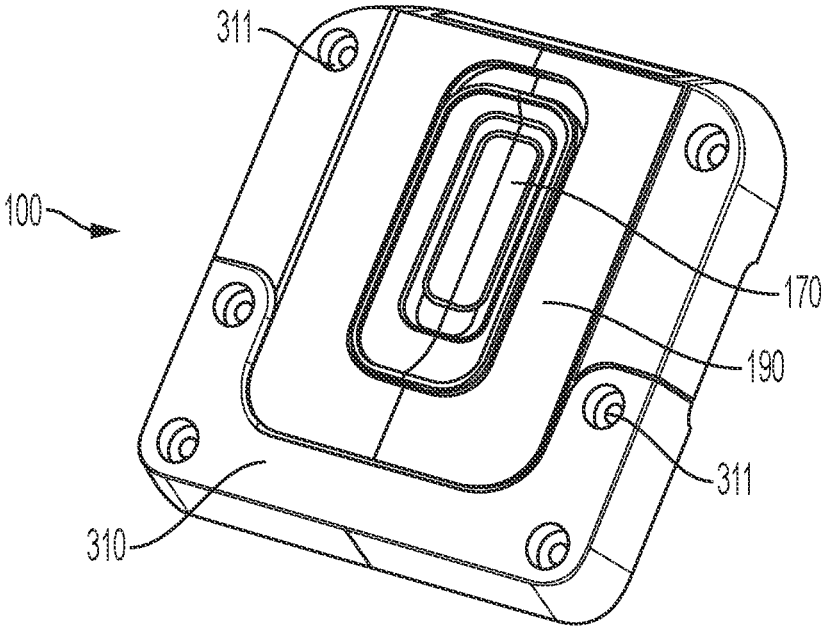
FIG. 1B is a perspective front view of the embodiment of FIG. 1A in a compressed position.
Figure 2A:
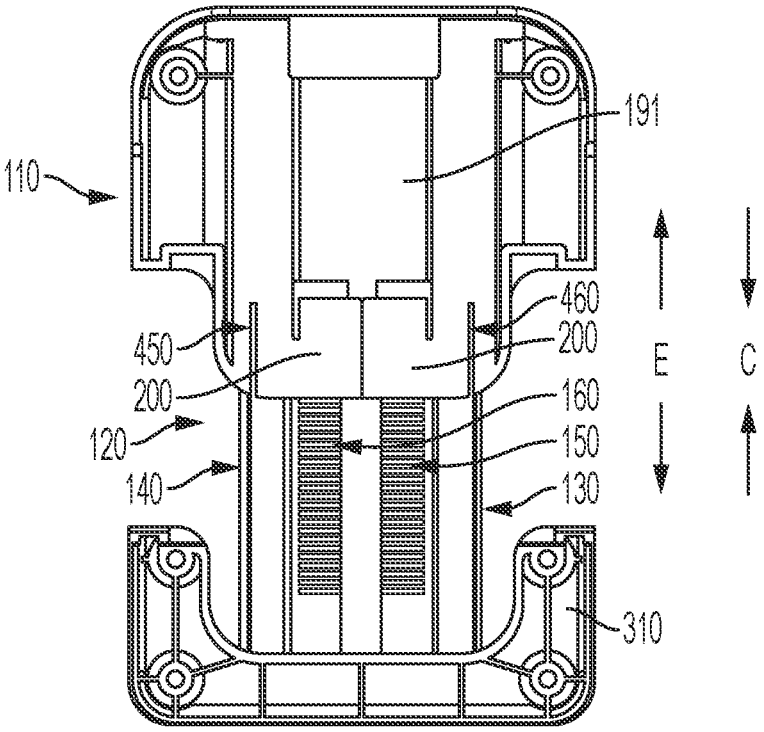
FIG. 2A is a plan view of the back of the embodiment of FIG. 1A.
Figure 2B:
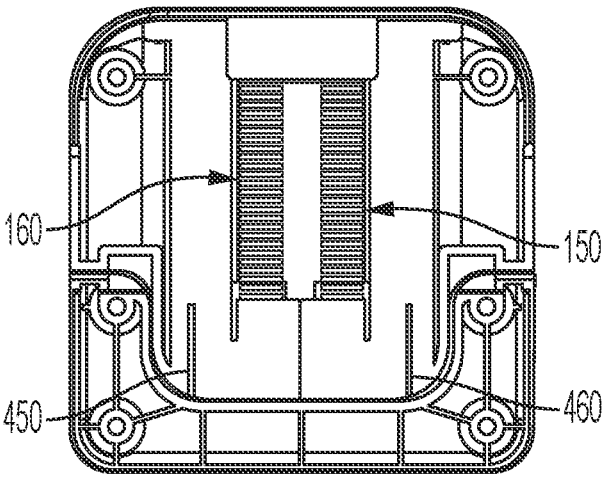
FIG. 2B is a plan view of the back of the embodiment of FIG. 2B.
Figure 3:
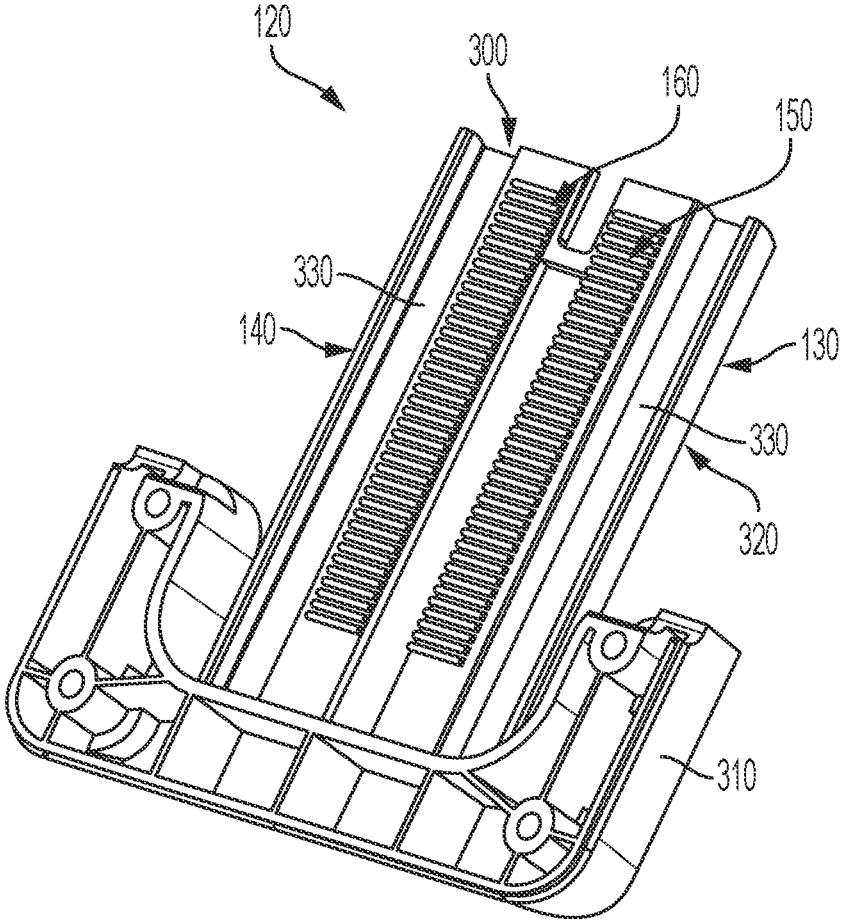
FIG. 3 is a perspective view of the rack member of the embodiment of FIG. 1A.

The ensuing detailed description is made with reference to the figures. This is for convenience only and is not limiting to the scope of the disclosure. The entire contents of U.S. Pat. Nos. 9,560,902; 9,801,440; and 10,349,712 are incorporated herein by reference.

Referring to FIGS. 1-5, thereat is an embodiment of the compression-expansion locking device 100 of the disclosure comprising a housing member 110 comprising an internal passageway 400 and two columns of parallel housing teeth 410, 420 protruding into the internal passageway, and a pair of housing cam elements 430, 440, each housing cam element disposed in axially adjacent relation to a respective one of the columns of parallel housing teeth. The embodiment shown comprises a rack member 120 comprising a pair of rack arms 130, 140 slidably received in the internal passageway 400, each parallel rack arm comprises a respective column of parallel rack teeth 150, 160 adapted to releasably engage a respective one of the columns of parallel housing teeth 410, 420 and to allow movement as between the housing member 110 and the rack member 120 in a compression direction (shown by arrow C) and to lock movement as between the housing member 110 and the rack member 120 in an expansion direction (shown by arrow E). Release member 170 is moveably disposed in the internal passageway 400 between the inside of the housing member 110 and the side of the rack member opposite the rack teeth 150, 160, the release member 170 comprising a release cam 180 that projects between the pair of parallel rack arms 130, 140. The release member 170 is displaceable from a first position wherein movement between the housing member 110 and the rack member in the expansion direction is locked (shown in FIGS. 8A, 9A), to a second position wherein the release cam impinges against at least a portion of each housing cam element effective to urge the housing teeth 410, 420 away from the rack teeth 160, 150 sufficient to allow movement as between the housing member 110 and the rack member 120 in the expansion direction (shown in FIGS. 8B, 9B).

Figure 5A:
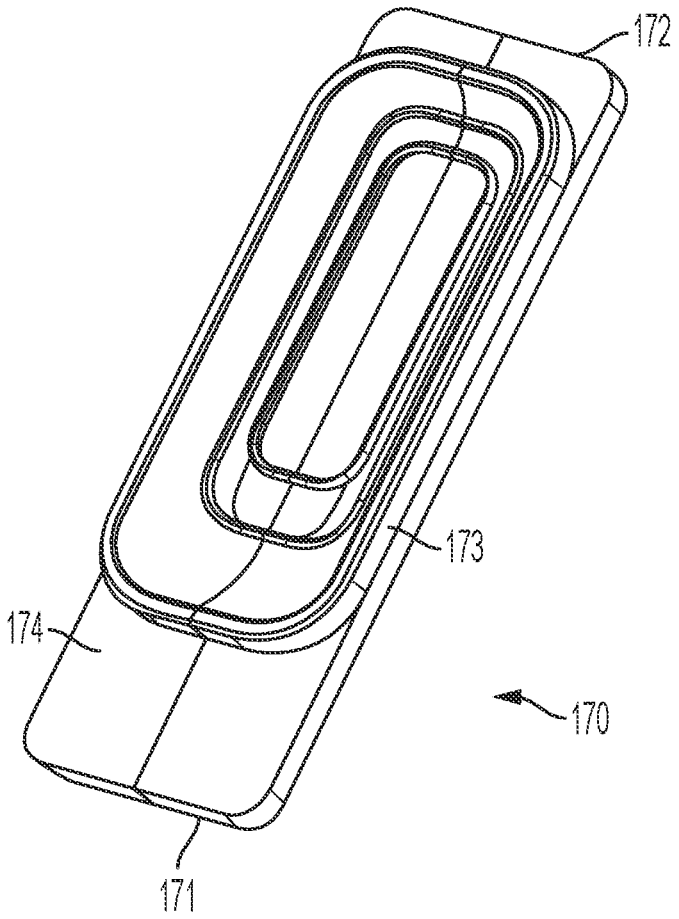
FIG. 5A is a perspective view of the front of the release member in the embodiment of FIG. 1A.
Figure 5B:
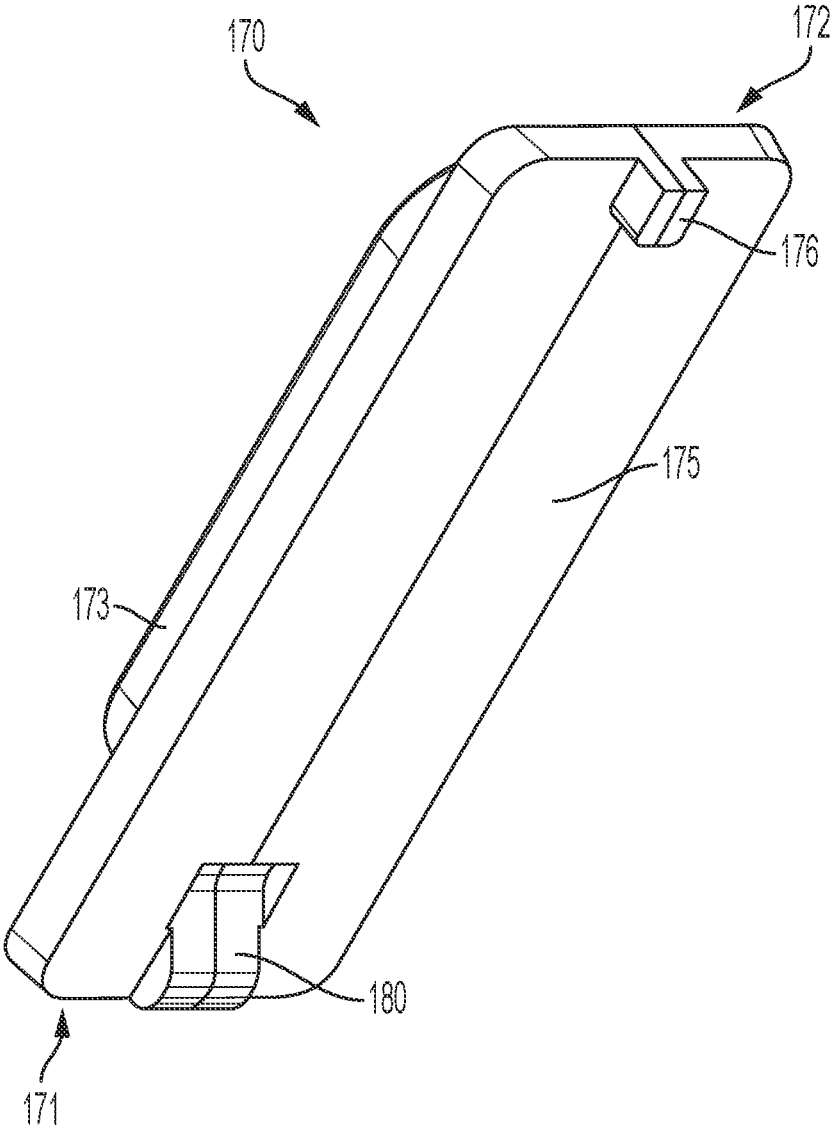
FIG. 5B is a perspective view of the back of release member of FIG. 5B
Figure 7C:
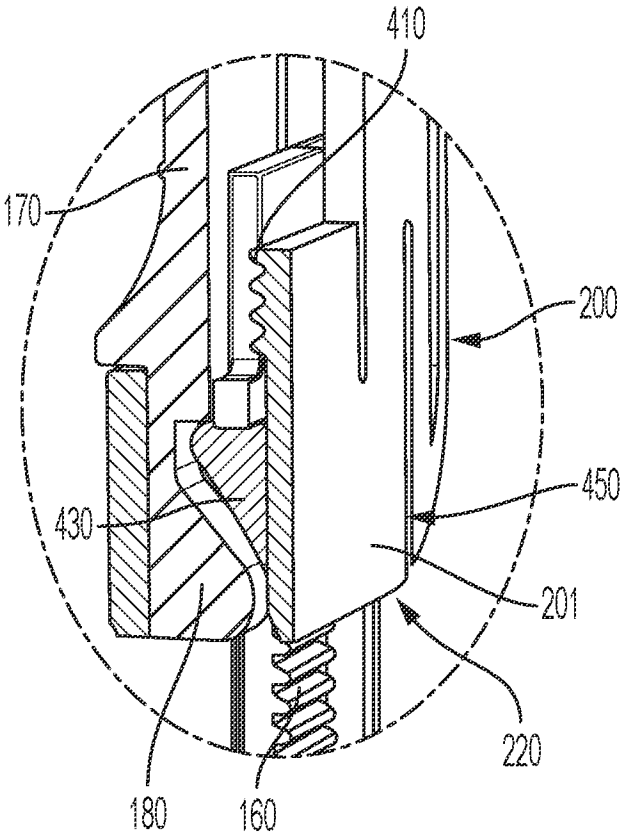
FIG. 7C is a perspective view of the midline cross-section of FIG. 7B.
Figure 7B:
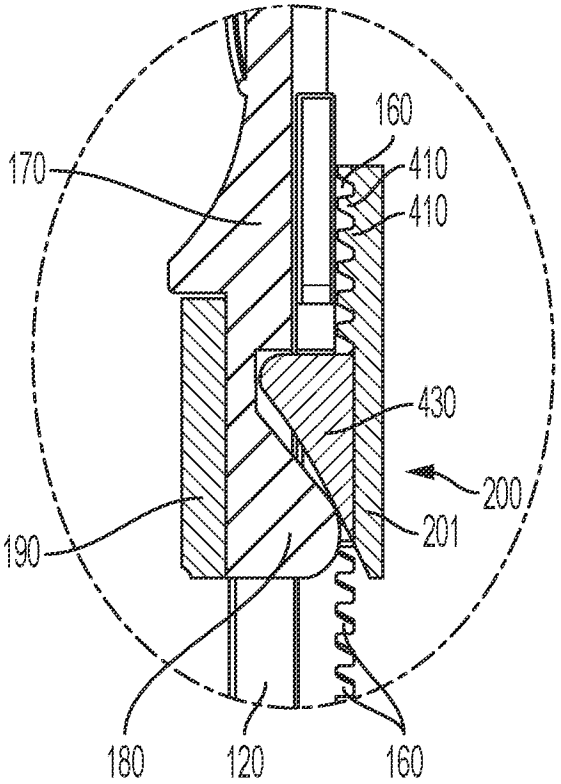
FIG. 7B is an enlargement of the midline cross-sectional portion circled in FIG. 7A.
Figure 7A:
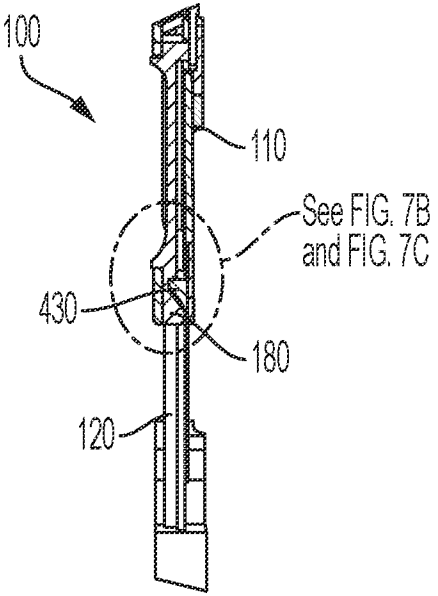
FIG. 7A is a midline cross-sectional view of the embodiment of FIG. 1A.

In the embodiment shown, the housing member 110 comprises a front wall portion 190, a rear wall portion 200, opposing side walls 290, 291, a top end 210, and a bottom end 220, comprising an edge opening 230, where at least the front wall portion 190 and the rear wall portion 200 cooperatively define the interior passageway 400. In the practice shown, the two columns of parallel housing teeth 410, 420, protrude from the rear wall portion 200 into the internal passageway, and the pair of housing cam elements 430, 440 protrude from the rear wall portion 200 and extend into the interior passageway 400 at a distance beyond that of the housing teeth (as shown in FIGS. 7 and 8). As depicted, each housing cam element 430, 440 is disposed between the edge opening 230 at bottom end 220 and a respective one of the columns of parallel housing teeth 410, 420 with the housing cam elements laterally aligned and separated by a spacing distance. Rack member 120 comprises a top edge 300, a base portion 310, and each of the pair of parallel rack arms 130, 140 comprise a front side 320 facing the front wall portion of the housing member and a rear side 330 facing the inside surface 201 of the rear wall portion 220 of the housing member 110 from which rear side 330 the rack teeth 150, 160 protrude. In one practice, the front wall portion 190 of housing member 110 comprises an opening 191 and the release member 170 is accessible for displacement from the first position to the second position through opening 191. As shown in FIG. 5, in one embodiment, release member 170 is of elongate shape and comprises a release member top portion 172 and a release member bottom portion 171, release member top surface 174 and release member bottom surface 175. In the practice shown, release member 170 comprises flange 173 which extends outwardly from the top surface 174 and is configured to fit within front wall opening 191 to serve as a guide when the release member is displaced from the first position to the second position and to stop the movement once the second position is reached. Optionally, release member 170 can comprise boss 176 which can fit into an optional complementary shaped slot in the housing member (not shown) to secure and stabilize the release member when disposed in the housing and to further direct and limit movement. In one practice, the front wall portion and the rear wall portion are both generally rectilinear and planar. In one embodiment (not shown) the rear wall portion can be of substantially the same size and shape as the front wall portion. Through-holes 311 facilitate securement to the article of luggage e.g. via screws, rivets, bolts and the like.

Figure 4A:
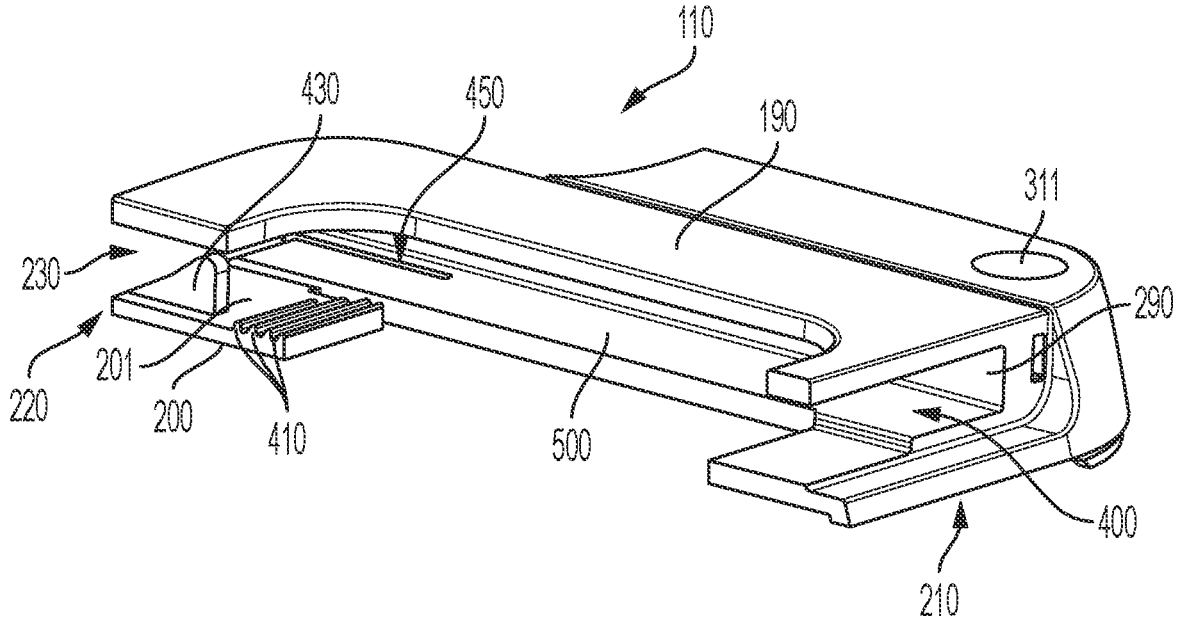
FIG. 4A is a perspective view of a portion of the housing member of the embodiment of FIG. 1A.
Figure 4B:
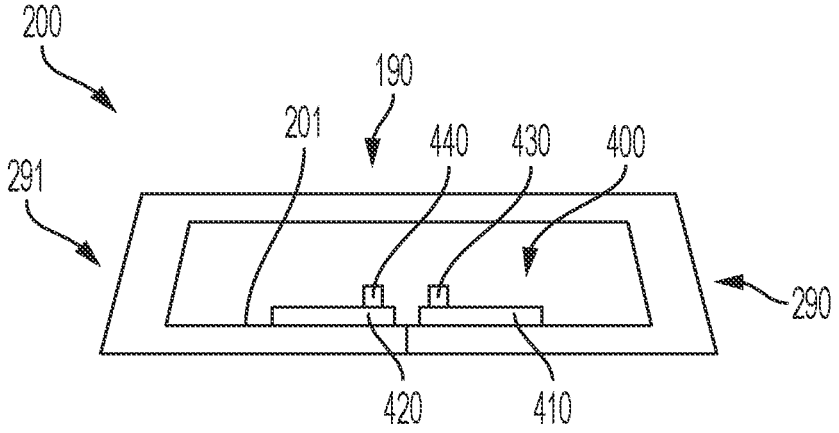
FIG. 4B is a generalized top down view of the housing member of FIG. 4A.
Figure 4C:
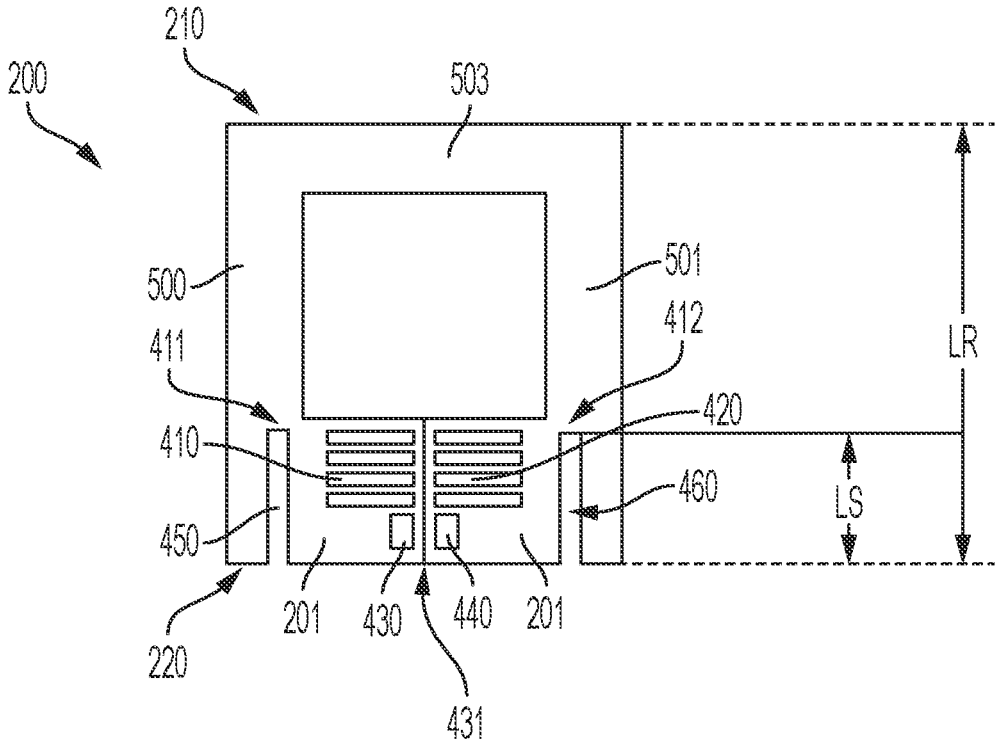
FIG. 4C is a generalized plan view of the inside surface of the rear wall portion of FIG. 4A with the front wall removed to show the rear wall portion with housing teeth and housing cams.

In another embodiment, as particularly seen in FIG. 4C, the rear wall portion can be in the shape of a rectilinear frame comprising two substantially parallel upright members 500, 501, and an upper transverse section 503 connected to or integral with the two upright members 500, 501, proximate the top end 210, and a lower transverse section 201 connected to or integral with the upright members 500, 501, distal to the top end 210 and proximate the bottom end 220. The lower transverse section can be a unitary piece; or the lower transverse section can be bisected, e.g. along line 431 into two halves that abut and together form the lower transverse section 201. This embodiment and other embodiments described herein can optionally comprise two slots, 450, 460, which can be parallel, wherein each slot 450, 460, is located on a respective upright member 500, 501 forming the rear wall portion and each is equally laterally spaced from the outside edge of a respective one of the columns of parallel housing teeth that is proximate the respective upright, each slot 450, 460, extending perpendicularly from the bottom edge 220 of the rear wall portion, e.g. the upright members 500, 501, toward the top end; in one practice, each slot 450, 460, extends into the rear wall portion, e.g. the upright members, to approximately the same length of the columns of parallel housing teeth, e.g. each slot terminates at approximately the same lateral point as the end of column of parallel housing teeth 410, 420 that is distal from the bottom edge 220. In this embodiment, the combination of slots 450, 460 and the bisection 431 results in a lower transverse section 201 in the form comprised of flaps, one flap comprising housing teeth 410 and housing cam 430 and capable of movement away from the plane defined by the respective upright member 500, e.g. at hinge point 411; and the other flap comprising housing teeth 420 and housing cam 440, and capable of movement away from the plane defined by the respective upright member 501, e.g. at hinge point 412.

In one aspect, as seen in FIG. 4C, the rear wall portion 200 comprises a first length LR measured from the bottom end 220 to the top end 210, and the lower transverse section 201 has a length LS measured from bottom end 220, wherein length LS is less than the length LR, e.g. LS is about three quarters the length LR (LS=0.75 LR), or about one half the length LR (LS=0.50 LR), or about one quarter the length LR (LS=0.025 LR).

Figure 8A:
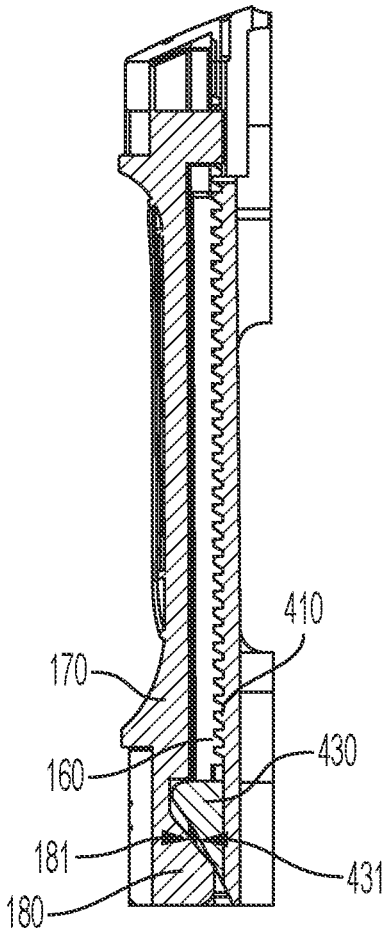
FIG. 8A is a cross-sectional view of the embodiment of FIG. 1A in a fully compressed state with the release member in a first position with the housing teeth and rack teeth engaged in a locking position.
Figure 8B:
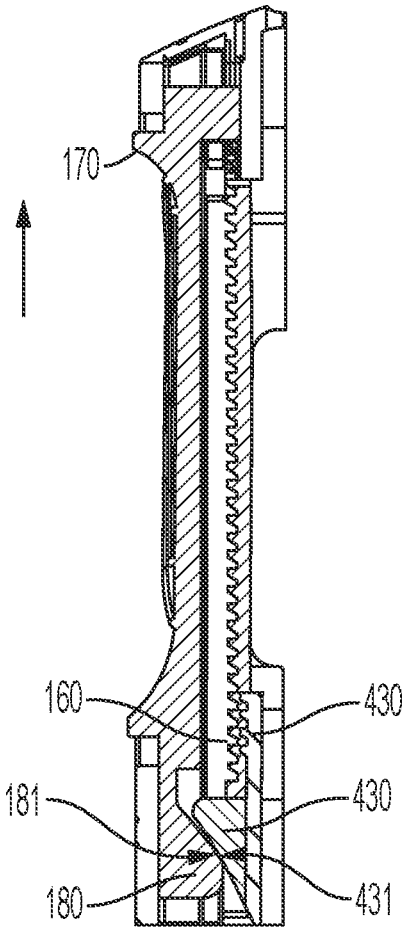
FIG. 8B shows the embodiment of FIG. 8A with the release member in a second position with the housing teeth and rack teeth urged away from each other to allow movement in an expansion direction.
Figure 9A:
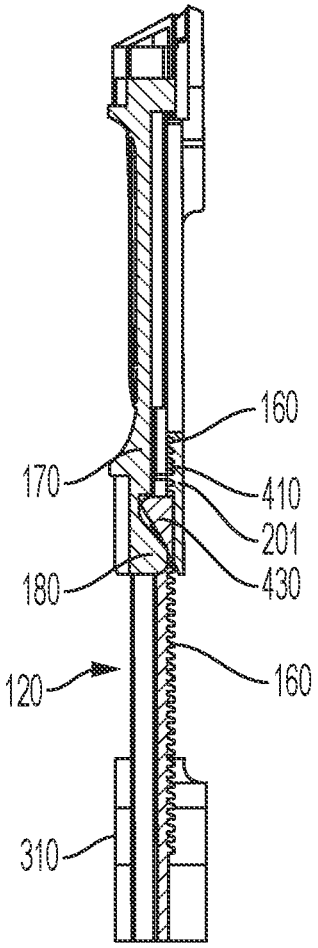
FIG. 9A is a cross-sectional view of the embodiment of FIG. 1A in a locked expanded state with the release member in a first position with the housing teeth and rack teeth engaged in a locking position.
Figure 9B:
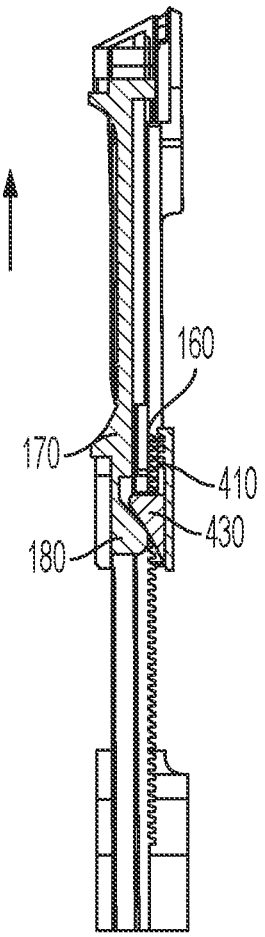
FIG. 9B shows the embodiment of FIG. 9A with the release member in a second position with the housing teeth and rack teeth urged away to allow movement in an expansion position.

Referring to FIGS. 7, 8, and 9, the pair of housing cam elements, 430, 440, can each individually be of any shape or size; in one practice each cam element 430, 440 are of substantially identical size and substantially identical shape, and each are of a generally first triangular cross section as exemplified in FIG. 7. The release cam 180 can also be of any shape or size subject to being able to maintain the rack member 120 and rack teeth 160 in a locked position in the first position (See FIGS. 8A, 9A) and to impinge sufficiently against at least a portion of one of the housing cams sufficient to urge the housing teeth away from the rack teeth to allow movement as between the housing member and the rack member when the release member is displaced to the second position (see FIGS. 8B, 9B, the arrows indicated the direction in which the release member 170 is displaced). In one practice, one release cam 180 is present on release member 170 and is of a generally second triangular cross section that is complementary to the first triangular cross section of the housing cam elements, e.g. the sloped faces of housing cam elements, 430, 440 (see FIG. 8 showing sloped face 431 of housing cam 430), is complementary to the sloped face 181 of release cam 180 such that when release member 170 is displaced to the second position the sloped faces slide against each other to move the housing teeth and/or the rack teeth away from each other. In one aspect, the second triangular cross section is greater than the first triangular cross section.

The compression-expansion locking device may comprise any suitable material of construction or combinations of such materials, including without limitation materials that are rigid yet flexibly resilient enough to permit the urging away of the housing teeth from the rack teeth, e.g. all or part of the device, such as the rear wall portion and/or the rear transverse section can comprise plastic, including without limitation plastics exemplified by polyoxymethylene copolymer (POM-C) high rigidity grade.

Figure 6:
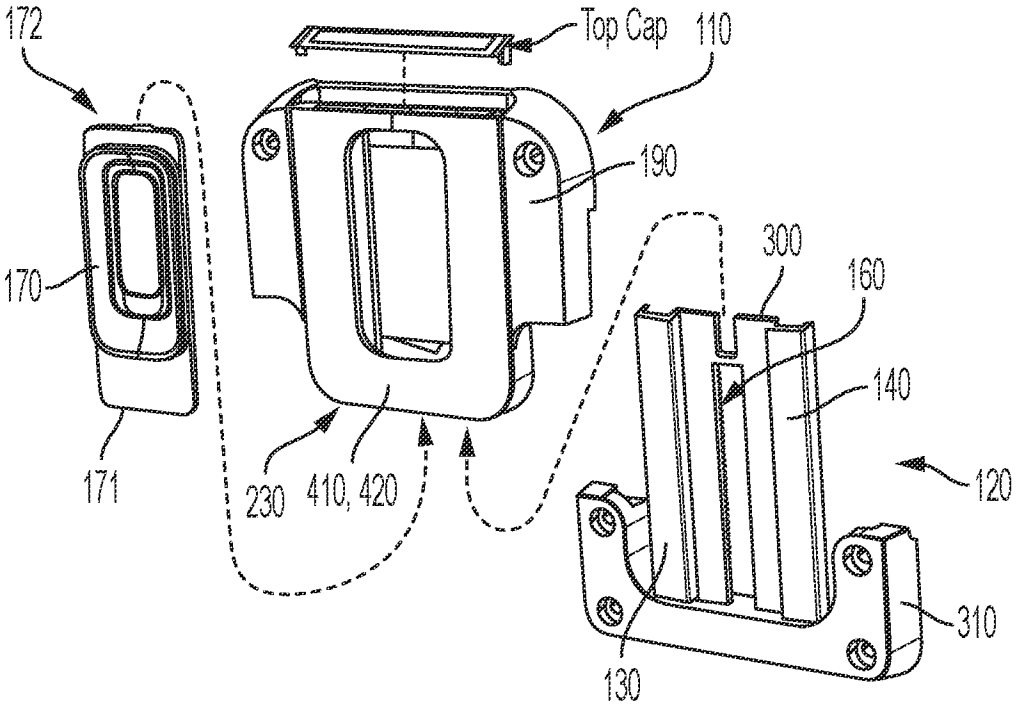
FIG. 6 is a depiction of the assembly of the embodiment of FIG. 1A.

Referring to FIG. 6, the embodiment illustrated can be assembled by first sliding rack member 120 via its top edge 300 into bottom edge opening 230 of housing 110 and aligned so that rack teeth 150 (not shown) and 160 face housing teeth 410, 420. Then release member 170 is inserted between the side of rack member 120 opposite the rack teeth and housing member 110 such that release cam 180 faces housing cam elements 430, 440.

Figure 10:
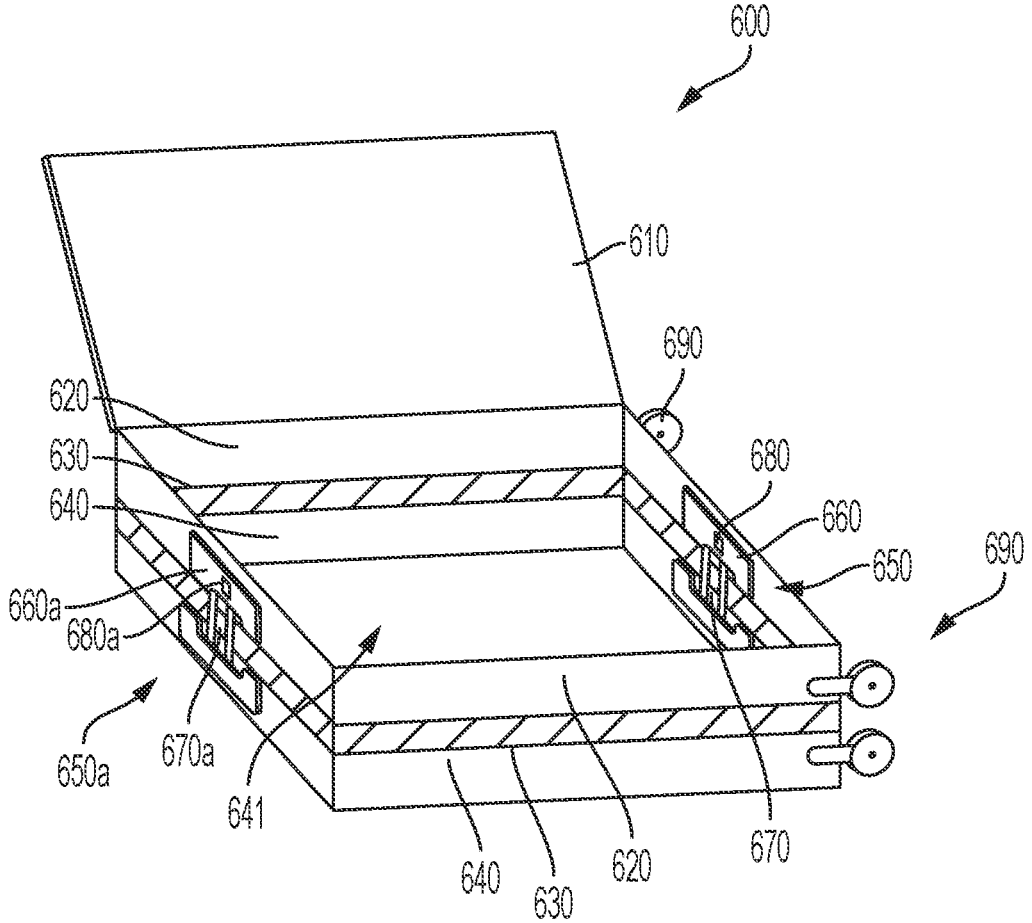
FIG. 10 is a perspective view of the internal area of an embodiment of an article of luggage of the disclosure employing the compression-expansion locking device of FIG. 1A.

FIG. 10 depicts an embodiment of an article of luggage contemplated by the disclosure embodying the compression-locking device of the disclosure, e.g. as shown in FIGS. 1-9. Article of luggage 600 comprises a main luggage body 640 having a bottom surface 641 forming a cavity to receive articles for packing. The article of luggage further comprises an expansion body 620 having a perimeter defining a cavity. Foldable gusset 630 joins luggage body 640 to expansion body. Gusset 630 allows the expansion body to move towards the luggage main body in order to vary the size of a volume formed by the cavity of the luggage main body and the cavity of the expansion body. Gusset 630 can be foldable or compressible and can comprise cloth or other suitable material. Cover 610 is attached to the expansion body 620 and is sealable and openable by e.g. zippers and the like. Article of luggage 600 can be soft-sided or hard-sided or combinations of both and can comprise materials of construction including cloth, metal and plastic. Article of luggage 600 can comprise spinner wheels 690 or rolling wheels or feet or any combination of the foregoing and can comprise one or more handles including a telescoping handle attached to main luggage body. In one embodiment, at least one compression-expansion locking device as described herein is affixed, e.g. by screws, rivets, guide panels and the like, at an inner wall of the article of luggage. Multiple such devices can be installed, e.g. at opposing inner walls.

As shown in the practice of FIG. 10, two compression-expansion locking devices 650, 650*a* are disposed internally at respective opposite inner walls of the article of luggage 600. The compression-expansion locking device can comprise, for example, as described herein, a housing member affixed to one of the luggage main body or the expansion body, the housing member comprising an internal passageway, two columns of parallel housing teeth protruding into the internal passageway, and a pair of housing cam elements, each housing cam element disposed in axially adjacent relation to a respective one of the columns of parallel housing teeth; a rack member, affixed to the other of the luggage main body or expansion body to which the housing member is affixed, the rack member comprising a pair of rack arms slidably received in the internal passageway, each parallel rack arm comprising a column of parallel rack teeth adapted to releasably engage a respective one of the columns of parallel housing teeth and to allow movement between the housing member and the rack member in a compression direction and to lock movement between the housing member and the rack member in an expansion direction; and a release member moveably disposed in the internal passageway between the housing member and the side of the rack member opposite the rack teeth, the release member comprising a release cam that projects between the pair of parallel rack arms, the release member displaceable from a first position wherein movement of the rack member in the expansion direction is locked, to a second position wherein the release cam impinges against at least a portion of each housing cam element effective to urge the housing teeth away from the rack teeth sufficient to allow movement between the housing member and the rack member in the expansion direction.

What is claimed is:

1. A compression-expansion locking device for an article of luggage which comprises:

a housing member comprising an internal passageway, two columns of parallel housing teeth protruding into the internal passageway, and a pair of housing cam elements, each housing cam element disposed in axially adjacent relation to a respective one of the columns of parallel housing teeth;

a rack member comprising a pair of parallel rack arms slidably received in the internal passageway, each parallel rack arm comprising a column of parallel rack teeth adapted to releasably engage a respective one of the columns of parallel housing teeth and to allow movement between the housing member and the rack member in a compression direction and to lock movement between the housing member and the rack member in an expansion direction; and a release member moveably disposed in the internal passageway between the housing member and the side of the rack member opposite the rack teeth, the release member comprising a release cam that projects between the pair of parallel rack arms, the release member displaceable from a first position wherein movement of the rack member in the expansion direction is locked, to a second position wherein the release cam impinges against at least a portion of each housing cam element effective to urge the housing teeth away from the rack teeth sufficient to allow movement between the housing member and the rack member in the expansion direction.

2. The locking device of claim 1 wherein the housing member comprises a front wall portion, a rear wall portion, a top end, and a bottom end, the front wall portion and the rear wall portion cooperatively define the interior passageway, the bottom end comprising an edge opening accessing the interior passageway.

3. The locking device of claim 2 wherein the pair of housing cam elements protrude from the rear wall portion and extend into the interior passageway at a distance beyond that of the housing teeth, and wherein each housing cam element is disposed between the edge opening and a respective one of the columns of parallel housing teeth, the housing cam elements laterally aligned and separated by a spacing distance.

4. The locking device of claim 2 wherein the rear wall portion comprises a transverse section distal from the top end, and wherein the two columns of parallel housing teeth and the housing cam elements protrude from the transverse section.

5. The locking device of claim 2 wherein the front wall portion comprises an opening and the release member is manually accessible for displacement from the first position to the second position through the opening.

6. The locking device of claim 2 wherein the front wall portion comprises a first length from the top end to the bottom end, and the rear wall portion extends from the bottom end and terminates before it reaches the top end at a second length which is less than the first length.

7. The locking device of claim 2 wherein the rear wall portion comprises two parallel slots, each slot laterally spaced from an outside edge of a respective one of the columns of parallel housing teeth and extending perpendicularly from the bottom edge of the housing member into the rear wall portion.

8. The locking device of claim 1 wherein the rack member comprises a top edge, a base portion, and each of the pair of parallel rack arms comprise a front side facing the front wall portion of the housing member and a rear side facing the rear wall portion of the housing member from which the rack teeth protrude from the rear side.

9. The locking device of claim 1 wherein the pair of housing cam elements are substantially identical size and shape and each are of a generally first triangular cross section; and the release cam is of a generally second triangular cross section that is complementary to the first triangular cross section of the housing cam elements.

10. The locking device of claim 9 wherein the second triangular cross section is greater than the first triangular cross section.

11. An article of luggage comprising:

a main luggage body having a bottom surface and a cavity formed to receive articles for packing;

an expansion body having a perimeter defining a cavity;

a foldable gusset joining the luggage main body to the expansion body; and a compression-expansion locking device disposed internally at respective opposite inner walls of the article of luggage, the compression-expansion locking device comprising:

a housing member affixed to one of the luggage main body or the expansion body, the housing member comprising an internal passageway, two columns of parallel housing teeth protruding into the internal passageway, and a pair of housing cam elements, each housing cam element disposed in axially adjacent relation to a respective one of the columns of parallel housing teeth;

a rack member affixed to the other of the luggage main body or expansion body, the rack member comprising a pair of parallel rack arms slidably received in the internal passageway, each parallel rack arm comprising a column of parallel rack teeth adapted to releasably engage a respective one of the columns of parallel housing teeth and to allow movement between the housing member and the rack member in a compression direction and to lock movement between the housing member and the rack member in an expansion direction; and a release member moveably disposed in the internal passageway between the housing member and the side of the rack member opposite the rack teeth, the release member comprising a release cam that projects between the pair of parallel rack arms, the release member displaceable from a first position wherein movement of the rack member in the expansion direction is locked, to a second position wherein the release cam impinges against at least a portion of each housing cam element effective to urge the housing teeth away from the rack teeth sufficient to allow movement between the housing member and the rack member in the expansion direction.

12. The article of luggage of claim 11 wherein the housing member comprises a front wall portion, a rear wall portion, a top end, and a bottom end, the front wall portion and the rear wall portion cooperatively define the interior passageway, the bottom end comprising an edge opening accessing the interior passageway.

13. The article of luggage of claim 12 wherein the pair of housing cam elements protrude from the rear wall portion and extend into the interior passageway at a distance beyond that of the housing teeth, and wherein each housing cam element is disposed between the edge opening and a respective one of the columns of parallel housing teeth, the housing cam elements laterally aligned and separated by a spacing distance.

14. The article of luggage of claim 12 wherein the rear wall portion comprises a transverse section distal from the top end, and wherein the two columns of parallel housing teeth and the housing cam elements protrude from the transverse section.

15. The article of luggage of claim 12 wherein the front wall portion comprises an opening and the release member is accessible for displacement from the first position to the second position through the opening.

16. The article of luggage of claim 12 wherein the front wall portion comprises a first length from the top end to the bottom end, and the rear wall portion extends from the bottom end and terminates before it reaches the top end at a second length which is less than the first length.

17. The article of luggage of claim 12 wherein the rear wall portion comprises two parallel slots, each slot laterally spaced from an outside edge of a respective one of the columns of parallel housing teeth and extending perpendicularly from the bottom edge of the housing member into the rear wall portion.

18. The article of luggage of claim 11 wherein the rack member comprises a top edge, a base portion, and each of the pair of parallel rack arms comprise a front side facing the front wall portion of the housing member and a rear side facing the rear wall portion of the housing member from which the rack teeth protrude from the rear side.

19. The article of luggage of claim 11 wherein the pair of housing cam elements are substantially identical size and shape and each are of a generally first triangular cross section; and the release cam is of a generally second triangular cross section that is complementary to the first triangular cross section of the housing cam elements.

20. The article of luggage of claim 19 wherein the second triangular cross section is greater than the first triangular cross section.

* * * * *